US007814633B2

(12) United States Patent
Slack

(10) Patent No.: US 7,814,633 B2
(45) Date of Patent: Oct. 19, 2010

(54) PIPE CENTRALIZER AND METHOD OF FORMING

(75) Inventor: Maurice William Slack, Edmonton (CA)

(73) Assignee: Tesco Corporation, Houston, TX (US)

( * ) Notice: Subject to any disclaimer, the term of this patent is extended or adjusted under 35 U.S.C. 154(b) by 912 days.

(21) Appl. No.: 10/528,277

(22) PCT Filed: Sep. 23, 2003

(86) PCT No.: PCT/CA03/01392

§ 371 (c)(1),
(2), (4) Date: Jun. 1, 2006

(87) PCT Pub. No.: WO2004/027207

PCT Pub. Date: Apr. 4, 2004

(65) Prior Publication Data

US 2006/0231250 A1 Oct. 19, 2006

(30) Foreign Application Priority Data

Sep. 23, 2002 (CA) ..... 2404577

(51) Int. Cl.
*B23P 17/00* (2006.01)

(52) U.S. Cl. ..... 29/421.1; 72/58; 72/61

(58) Field of Classification Search ..... 29/421.1; 72/57, 58, 59, 61
See application file for complete search history.

(56) References Cited

U.S. PATENT DOCUMENTS 349,718 A * 9/1886 Hollerith et al. ..... 72/59
4,319,471 A * 3/1982 Benteler et al. ..... 72/59
4,763,503 A * 8/1988 Hughes et al. ..... 72/57
6,092,593 A * 7/2000 Williamson et al. ..... 166/50
6,305,204 B1 * 10/2001 Tauzer ..... 72/62
6,409,226 B1 6/2002 Slack et al.
6,435,275 B1 8/2002 Kirk et al.
6,497,030 B1 * 12/2002 Marando ..... 29/421.1
6,820,317 B2 * 11/2004 Okada ..... 29/421.1

(Continued)

FOREIGN PATENT DOCUMENTS

DE 1002 423 2/1957

(Continued)

*Primary Examiner*—David P Bryant
*Assistant Examiner*—Christopher M Koehler
(74) *Attorney, Agent, or Firm*—Bracewell & Giuliani LLP

(57) ABSTRACT

A centralizer for installing on a metal pipe. The centralizer includes a generally tubular body having a central opening sufficiently large to allow insertion therethrough of a pipe having an external diameter; a sidewall of substantially uniform thickness including an inner-facing surface directed to the central opening and an outer-facing surface onto which are formed a plurality of outwardly protruding ribs by hydroforming the sidewall. A method for hydroforming a centralizer including placing a length of metal tubular work piece, the work piece having a sidewall and an central opening, inside a confining surface comprised of mold elements, the mold elements including cavities spaced and shaped in the configuration of desired side wall centralizer ribs, the mold elements being supported substantially against expansion radially outward from their position about the tubular work piece; applying sufficient pressure to the side wall through the inner bore to force the tubular sidewall radially outward against the confining surface and into the mold cavities to plastically deform the side wall to form centralizer ribs on the side wall; and removing the tubular work piece from the confining surface.

27 Claims, 5 Drawing Sheets

U.S. PATENT DOCUMENTS

| | | | | |
|---|---|---|---|---|
| 2001/0006109 | A1 | 7/2001 | Kaiser et al. | |
| 2003/0010540 | A1* | 1/2003 | Kirk et al. ..... | 175/325.5 |

FOREIGN PATENT DOCUMENTS

| | | |
|---|---|---|
| GB | 2 197 008 | 5/1988 |
| WO | WO 98/37302 | 8/1998 |
| WO | WO 98/46382 | 10/1998 |
| WO | WO 01/53652 | 7/2001 |
| WO | WO 01/66904 | 9/2001 |
| WO | WO 01/98622 | 12/2001 |
| WO | WO 02/31312 | 4/2002 |
| WO | WO 02/32596 | 4/2002 |

* cited by examiner

PIPE CENTRALIZER AND METHOD OF FORMING

FIELD OF THE INVENTION

The present invention relates to centralizers attached to pipe placed in boreholes. The invention discloses a method of hydroforming centralizers and means of their attachment to pipe.

BACKGROUND OF THE INVENTION

The processes of drilling and completing well bores in earth materials using tubular strings are frequently benefited if the tubular string is prevented from fully eccentering and generally contacting or laying against the borehole wall. Devices, typically referred to as centralizers, are employed to provide this function of reducing eccentricity, or centralizing, the tubular string within the borehole. These devices are configured to economically meet a variety of drilling and completion applications.

As disclosed in Canadian patent application 2350681, filed Jun. 15, 2001 in the name of TESCO Corporation, the demands of drilling with casing lead to the need for inexpensive casing centralizers which are rugged, for example resistant to rib failure, comparatively easy to attach to the casing and able to withstand drilling rotation sufficient to complete at least one well.

Such centralizers are also useful for applications beyond casing drilling.

SUMMARY OF THE INVENTION

A hydroformed centralizer and method of manufacture has been invented. The centralizer is suitable for installation on pipe, such as would be useful in well bore drilling and casing operations. The present invention provides a metal centralizer having a cylindrical body carrying outwardly projecting ribs, hydroformed into its sidewall, which when coaxially placed over a pipe may be retained by various means.

The means employed for attachment may be varied according to the needs of the application. For example, in applications such as drilling with casing, typically requiring sufficient structural capacity to substantially prevent significant relative movement of the centralizer on the pipe, the centralizer body is provided with at least one cylindrical interval suitable for attachment by the method of crimping as taught in the aforementioned Canadian Application 2350681.

For applications where centralizer rotation about the pipe on which it is attached, is allowable or preferred, but its axial position is sought to be fixed, the hydroformed centralizer can be installed between stop rings affixed to the pipe, as commonly implemented for casing running. The stop rings may be fixed to the pipe by the method of crimping or by other means generally known to the industry such as set screws threadably mounted in the side wall of the stop rings.

Thus, in accordance with a broad aspect of the present invention, there is provided a centralizer comprising: a generally tubular body having a central opening sufficiently large to allow insertion therethrough of a selected pipe having an external diameter; a sidewall of substantially uniform thickness including an inner-facing surface directed to the central opening and an outer-facing surface onto which are formed a plurality of outwardly protruding ribs by means of hydroforming the sidewall.

In accordance with another broad aspect, the is provided a method for producing a centralizer, the method comprising the steps of: placing a length of metal tubular work piece, the work piece having a sidewall and an central opening, inside a confining surface comprised of mold elements, the mold elements including cavities spaced and shaped in the configuration of desired side wall centralizer ribs, the mold elements being supported substantially against expansion radially outward from their position about the tubular work piece; applying sufficient pressure to the side wall through the inner bore to force the tubular sidewall radially outward against the confining surface and into the mold cavities and thus plastically deform the side wall to form centralizer ribs on the side wall; and removing the tubular work piece from the confining surface.

In accordance with another broad aspect, there is provided a method for producing a centralizer for a pipe comprising: providing a tubular work piece selected to be formed into the centralizer having a central opening defining an inner diameter and a sidewall having an inner-facing surface directed toward the central opening and an outer-facing surface; providing a mold including a plurality of elements together forming a inner-surface defining a substantially cylindrical confining space and cavities formed in the inner surface positioned and configured so as to correspond to the position and configuration of ribs to be formed on the centralizer; positioning the tubular work piece and the mold elements such that the tubular work piece is within the substantially cylindrical confining space formed by the mold elements; securing the mold elements about the tubular work piece; applying sufficient fluid pressure against the sidewall to force the sidewall out against the mold elements and into the cavities of the mold elements to form a centralizer having ribs protruding outwardly

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DESCRIPTION OF THE PREFERRED EMBODIMENT

Figure 1:
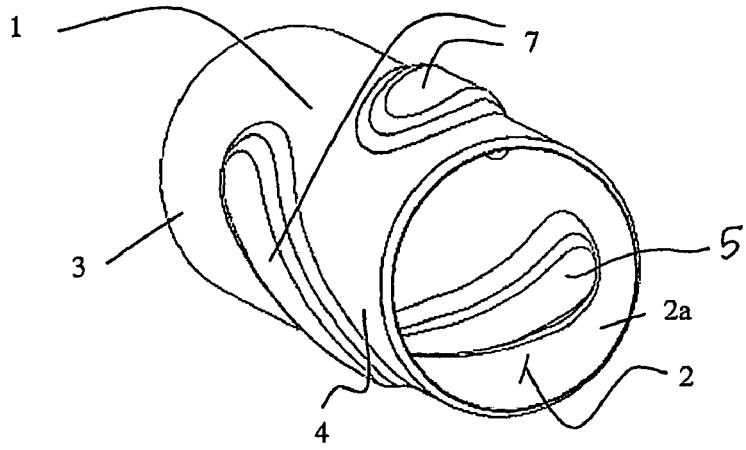
FIG. 1 is a perspective view of a centralizer according to the present invention.
Figure 2:
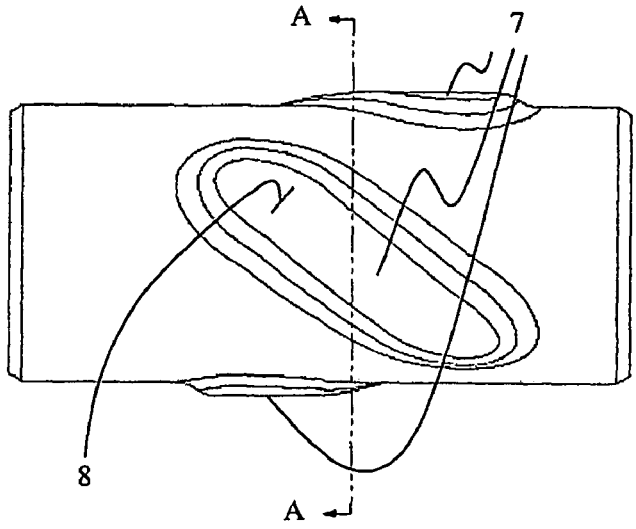
FIG. 2 is a side elevation of the centralizer shown in FIG. 1.
Figure 3:
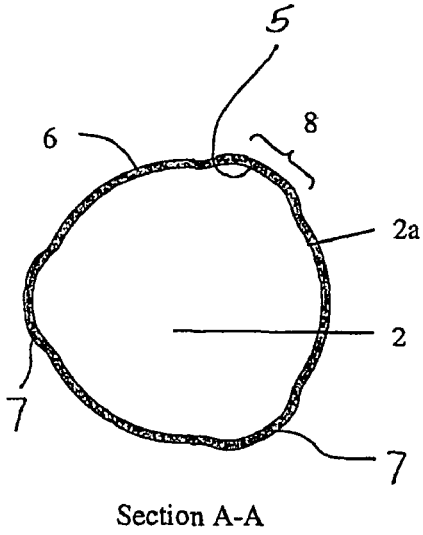
FIG. 3 is a section along line A-A of FIG. 2.
Figure 9:
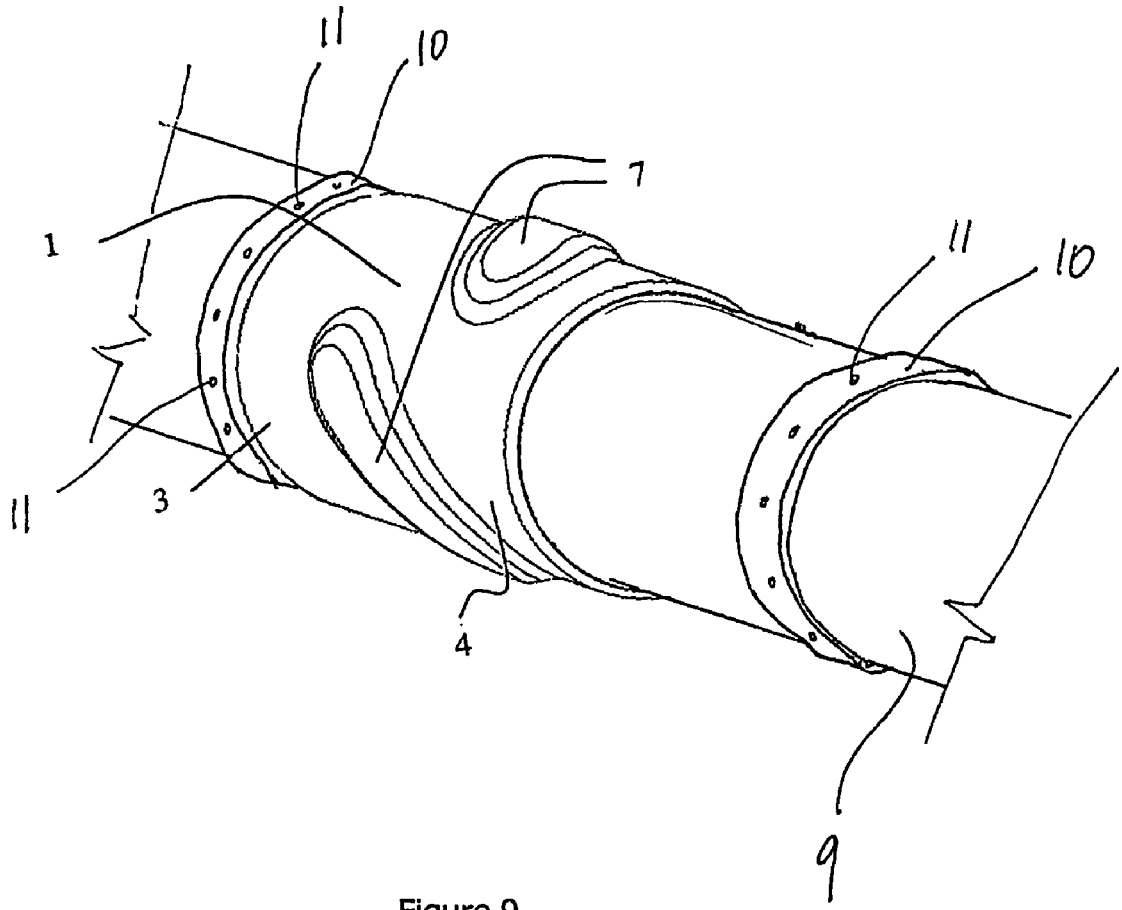
FIG. 9 is a perspective view of the centralizer shown in FIG. 1 placed on a joint of casing between two stop rings as it might appear prior to assembly into a string being installed in a well bore.

According to the present invention, a hydroformed centralizer is provided as shown in FIGS. 1 to 3, for placement on a pipe as shown in FIG. 9.

Referring to FIGS. 1 to 3, a centralizer 1 is provided in its preferred embodiment having a metal body sidewall 6 defining an internal bore 2, cylindrical ends 3, 4, and a main body interval into which outwardly projecting hydroformed ribs 7 are formed. While three ribs are shown, any number can be formed on the centralizer. In its preferred embodiment, one or both of cylindrical ends 3, 4 can provide intervals suitable for crimping, if it is desired that the centralizer be installable for crimping.

Ribs 7 can be evenly spaced around the main body interval and, in this illustrated embodiment, each rib extends along at least a portion of the length of the centralizer helically as commonly known to the industry. The ribs can be suitably shaped to accommodate the structural and flow requirements encountered in well bores and to stand the main cylindrical surface and ends 3, 4 from the borehole wall. As such the ribs provide a bearing surface 8 at their upper limits. The number, length and pitch of the rib helixes can be arranged so that the starting circumferential position of each rib overlaps the ending circumferential position of at least one adjacent rib.

In applications where the centralizer is rotated with the pipe, such as required for drilling with casing, the bearing surfaces 8 may be provided with a wear resistance coating such as hardfacing to protect the ribs 7 from wear against the borehole wall.

In applications where rotation of the centralizer on the casing is permitted, the internal bore 2 can wear against the pipe. In such applications, therefore, the surface defining the internal bore may be provided over all or a portion thereof with a suitable friction reducing coating 2*a* such as for example of polyurethane.

The placement of ribs 7 in the tubular wall is supported through provision of a hydroforming process. As shown in cross-section A-A of FIG. 2, the hydroforming process allows ribs to be placed in the sidewall of centralizer 1 with some thinning of the sidewall at the rib. The specific forming method expands the rib outward while constraining the remainder of the tube. The volume of the material in the region of the rib, therefore, stays constant and some thinning must occur to accommodate the greater surface area/perimeter length of the rib compared to the original tube wall. The amount of thinning actually possible without failing the material depends on various properties of the material used to form the centralizer. As an example, when using steel the thinning is in the order of about 25% such that the formed wall thickness is 75% of the original wall thickness.

The inner surface of the side wall is also deformed and includes indentations 5 that substantially follow the configuration of the outer ribs. The ribs can be formed with smooth, gradual, rather than sharp, surface transitions at the base and throughout the ribs.

In one embodiment, the hydroforming process includes placing a length of metal tubular work piece having a sidewall. The material of the tubular work piece is selected to accommodate plastic deformation and substantially retain the effects hydroforming, while being useful in downhole environments. In one embodiment, the centralizer is formed of ductile metals such as, for example, steel. To hydroform a centralizer, wall thickness combined with the material strength must provide sufficient strength to react the eccentering and perhaps lateral drilling forces encountered by the tubular. These forces vary significantly depending on tubular size, hole geometry, location in the hole, drilling or running, etc. Generally, for example, if using steel, the wall thickness of the material for forming the centralizer is greater than about 1/16". On a cost benefit analysis, an upper limit for steel wall thickness is about ½" for petroleum or even geothermal applications. In one embodiment, the material is steel having a wall thickness of ¼".

The tubular work piece is positioned inside a confining surface comprised of mold elements having cavities spaced and shaped in the configuration of the desired side wall protruding ribs. The confining surface can be generally cylindrical and positioned to generally align with the mid-section of the tubular work piece. The confining surface can be configured to support by cylindrical confinement opposite the end sections of the tubular work piece. The confining surface is contained within a support that holds the mold elements in position. The support can be a confining tube that holds the mold elements against movement radially outwardly away from the tubular work piece. Once the tubular elements are positioned about the tubular work piece, sufficient internal pressure can be applied against the inner surface of the side wall to force, as by inflating, the tubular sidewall radially outward against the confining surface and into the mold cavities and thus plastically form protrusions or ribs projecting outwardly from the side wall of the tubular work piece. The pressure is generated as fluid pressure, as by use of liquids contained to act at high pressures against the side wall. The ribs are formed, while substantially preserving the original tubular length. After formation of the ribs, the formed centralizer can be removed from the forming apparatus including the confining surface and its support. Removal of the mold elements from their support may require some force due to them becoming tightly jammed therein during hydroforming. Removal may be facilitated by providing a close fitting tapered collet between the support and the mold elements and means to axially displace the collet in the direction allowing radial expansion. If desired, the centralizer can then be treated, if required, by various means such as cropping, machining or applying coatings to improve wear resistance or to reduce friction.

Figure 4:
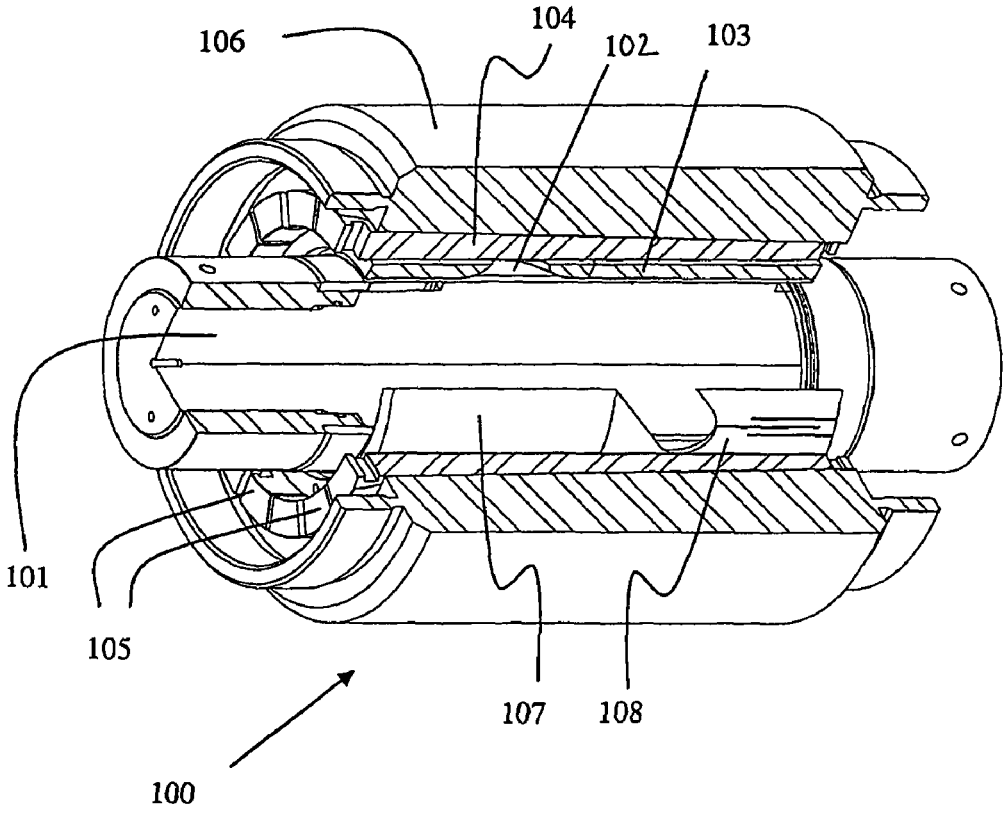
FIG. 4 is a perspective cutaway view through the wall of a hydroforming apparatus with coaxially positioned tubular work piece, a centralizer blank, installed therein. The view shows the mold elements and internal mandrel as they would appear prior to application of hydroforming pressure.

Referring now to FIG. 4, the placement of such ribs in the tubular wall is supported through provision of an apparatus 100 enabling implementation of a specialized hydroforming process. The apparatus includes an assembly of close fitting largely cylindrical components sized to fit within and about the tubular work piece to be handled. Beginning with the innermost and progressing outward, these components are: a mandrel 101, a mold assembly 103 comprised of elements 107, 108, an externally tapered collet 104 comprised of an assembly of jaws 105 and a confining support vessel or bell 106 internally tapered to mate with the collet. A means to apply axial displacement between collet 104 and bell 106 can be provided, such as a double acting hydraulic actuator (not shown). As will be apparent to one skilled in the art the axial displacement is converted to radial displacement by the collet jaws 105 moving in contact with the bell 106 facilitating installation and removal of the close fitting parts.

For hydroforming, a tubular work piece 102, from which a centralizer is to be formed, is positioned between mandrel 101 and mold assembly 103.

Figure 5:
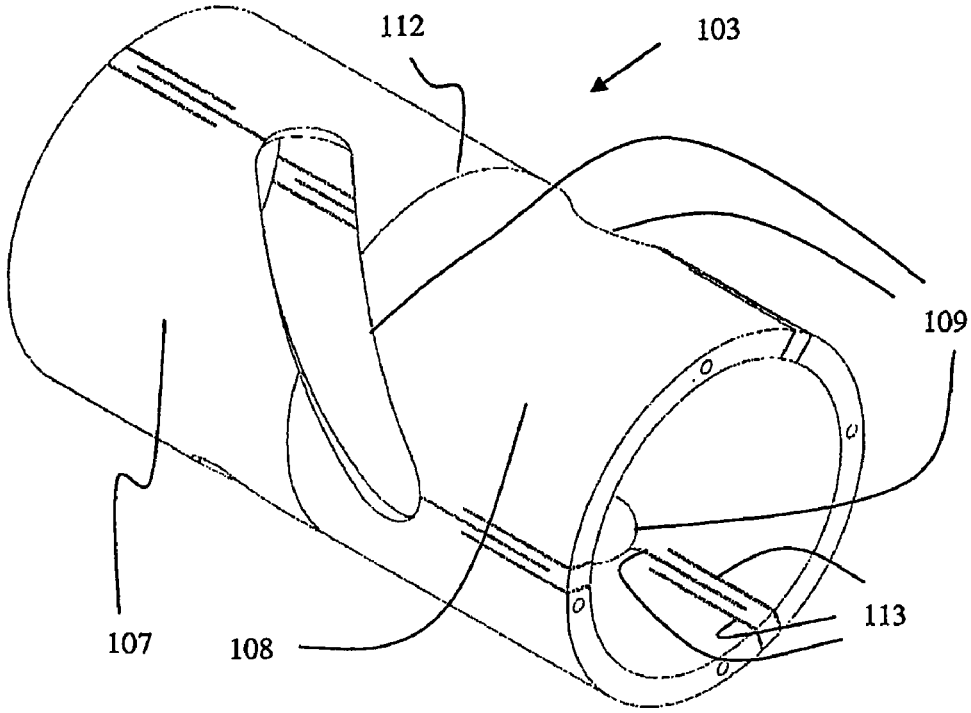
FIG. 5 is a perspective view of the mold elements comprising part of the hydroforming apparatus shown in FIG. 4.

Referring now to FIG. 5, in one embodiment the mold assembly 103 is comprised of two elements 107, 108 mating at split line 112 and having three helical cavities 109, generally shaped as the inverse of the desired rib geometry. The cavities can be closed or open through the mold, as shown. The form of the cavities dictates the shape of the ribs that will be formed from the mold. For example, the cavities can be formed to have abrupt edges to cause the ribs (FIG. 8) to protrude abruptly, with edges of lower radius, from the cylindrical surface of the side wall. As will be appreciated, due to the plastic deformation that occurs during hydroforming, sharper edges can be achieved more readily where the deformation causes the work piece material to bend around a corner, rather than into a corner. Alternately, the cavities can have more gradual side walls (FIG. 5) with large radiused edges to cause the ribs (FIG. 1) to have a smooth transition from the cylindrical surface of the side wall.

Removal of the mold elements from the formed centralizer after hydroforming can be facilitated by the slits 113 that act to introduce hoop compliance. Additionally, each mold element can form a portion of a cavity so that the elements are not engaged on the centralizer by the protrusion of a rib into a cavity.

Figure 6:
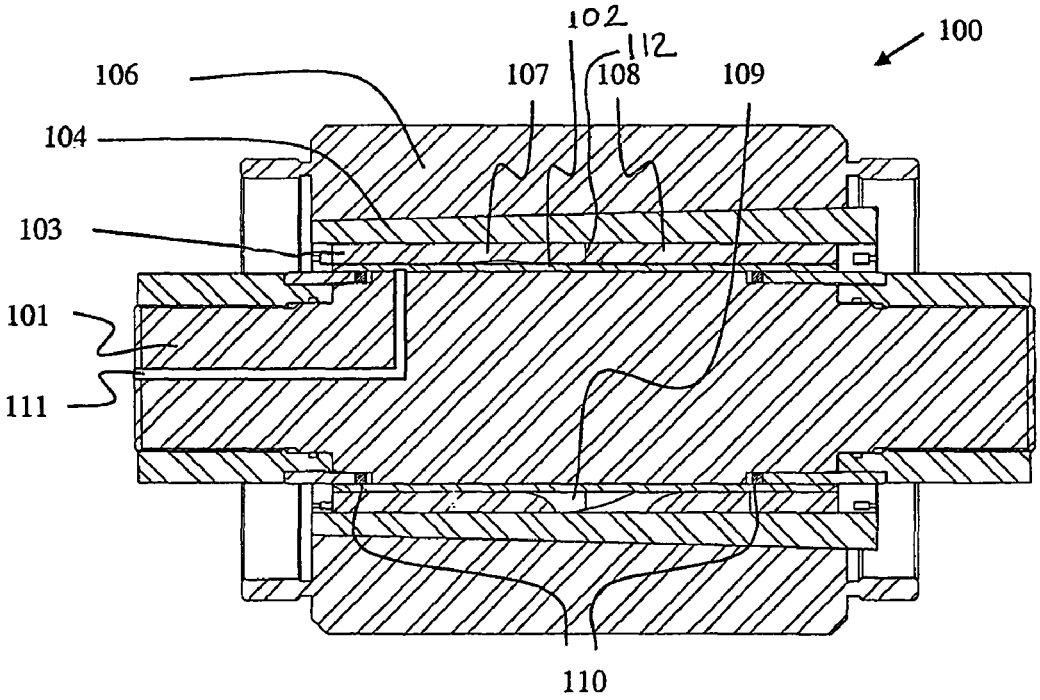
FIG. 6 is the sectional view through the entire wall of the assembly shown in FIG. 4 as it would appear before application of forming pressure.

Referring now to FIG. 6, the mandrel 101 is provided with internal seals 110 sized to seal against the inside bore 2 of the work piece blank 102 and a fluid entry port 111 open to the mandrel outer surface between seals 110. When the work piece blank 102 is positioned about the mandrel, any fluid applied through port 111 is thus contained by the work piece, mandrel 101 and seals 110, these components all being in sealing engagement. This allows application of fluid pressure to the internal surface of the workpiece 102 by suitable means such as may be provided by water, a high pressure gas, elastomers or hydraulic fluid. It is to be understood that the fluid employed to apply hydroforming pressure can be any fluid capable of transferring pressure with relatively little resistance from shear stress.

Pressures required to hydroform depend, for example, on the strength of the material to be formed and the radius of the curvature to which the wall is formed. In one embodiment, pressures are from 100 to 200 Mpa (15,000 to 30,000 psi). Seals 110, etc. must be capable of containing such pressures.

Figure 7:
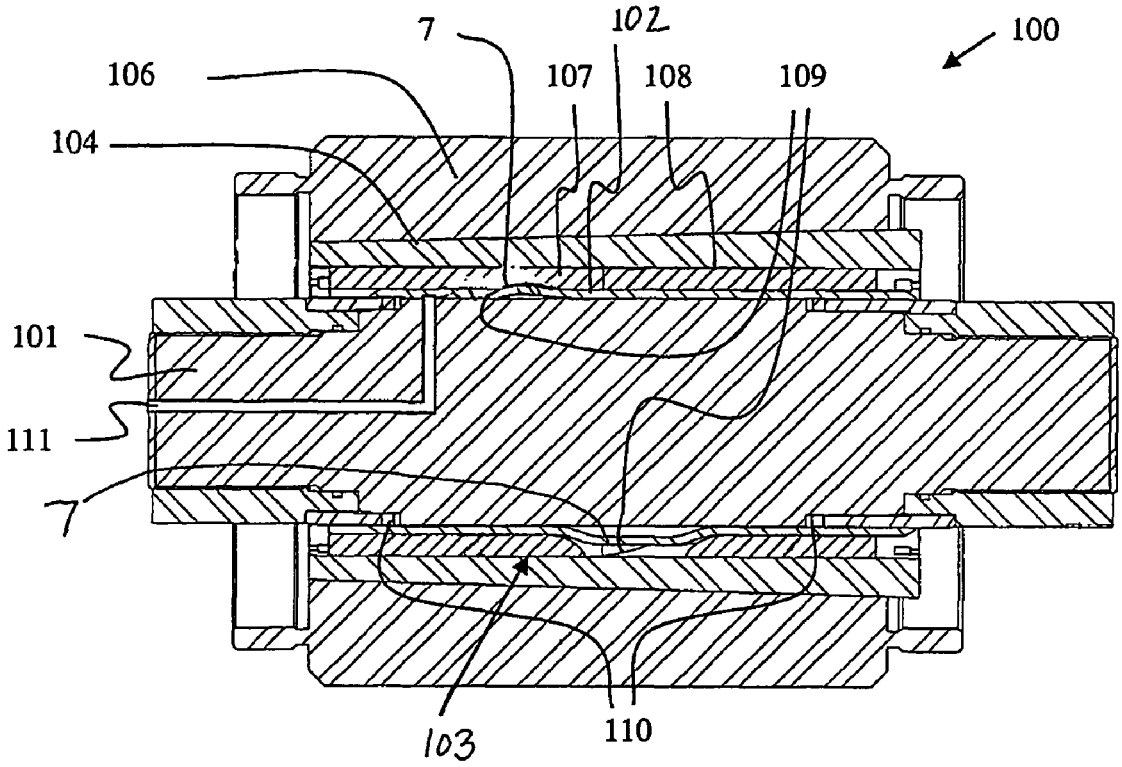
FIG. 7 is the sectional view through the entire wall of the assembly shown in FIG. 4 as it would appear after application of forming pressure.

Referring now to FIG. 7, application of sufficient fluid pressure through port 111 causes the work piece 102 to expand and plastically deform unless constrained by contact with the internal surface of the containing mold, thus inflating the sidewall of the work piece 1 into the mold cavities 109. This forms ribs 7 in the work piece, therefore forming a centralizer from the work piece. The portion of the pressure force reacted by the mold 103 is in turn reacted through the collet 104 into the bell 106. Due to the tapered interface between the collet 104 and bell 106, the collet 104 may tend to slip in the bell 106 while under pressure load allowing unwanted expansion of the work piece 102. This movement may be readily prevented by application of axial load or other suitable means of restraint between the collet jaws 105 and bell 106. Upon removal of the forming pressure, the mandrel 101 is readily removed, however a residual radial stress or interference may exist between the work piece 102 and mold 103 tending to resist removal of the work piece and the mold from collet 104. This radial stress is relieved by appropriate displacement of the collet relative to the bell enabling removal of the work piece 102 together with the mold elements 107, 108, since the formed ribs 7 are interlocking with the mold cavities 109 after forming. Once removed from the forming apparatus 100 the mold elements 107, 108 may be removed from the centralizer formed from work piece 102.

A hydroformed centralizer can be installed using various means onto a pipe for use in a wellbore. For example, means of mounting the centralizer body on a metal pipe can allow free rotation of the hydroformed centralizer on the metal pipe. If desired, the means of mounting can limit the centralizer's range of axial travel. In such an embodiment, mounting can include placement of the centralizer on the metal pipe between two surfaces upset sufficiently with respect to the metal pipe external diameter to abut the ends of the centralizer body. The abutting surfaces typically provided by the shoulders of stop rings placed coaxially on the pipe on either side of the centralizer, the stop rings being fixed to the metal pipe by means of set screws, bonding or crimping. The means of crimping the stop rings can follow the teachings provided in Cdn. App. 2350681. The selected metal pipe can be, for example, casing for drilling or lining a borehole or drill pipe.

As another example, the hydroformed centralizer can be installed to provide axial load and torque transfer by securing the centralizer to move both rotationally and axially with the pipe on which it is attached.

Figure 8:
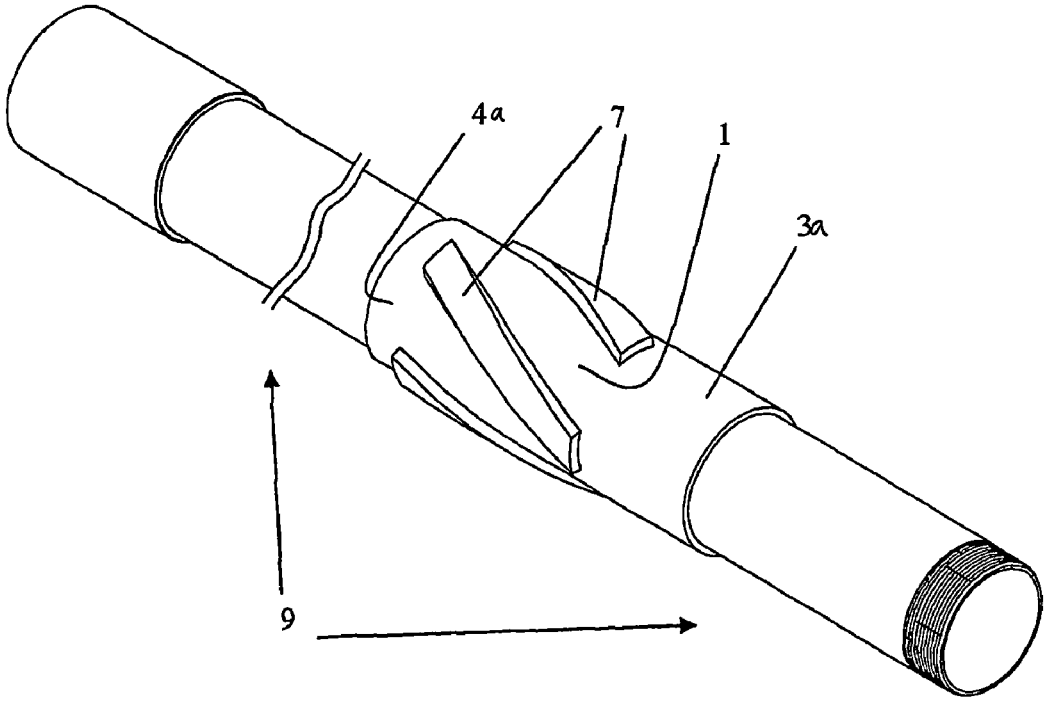
FIG. 8 is a perspective view of a centralizer placed on a joint of casing as it might appear prior to assembly into a string being installed in a well bore.

Referring to FIG. 8, in one embodiment the internal bore 2 of the formed centralizer body 1 can be arranged to loosely fit over at least one end of a pipe, shown as a threaded and coupled casing joint 9. This allows the centralizer to be readily placed somewhere along the length of the casing joint 9. When the casing joint is made up into a string, the centralizers are free to rotate and are constrained to slide between the couplings connecting the casing joints, which method of incorporating centralizers into a string is well known in the industry.

For applications requiring structural attachment of the centralizer 1 to the casing 9 enabling torque transfer, the centralizer can be fixed to the casing by crimping one or both of the end intervals 3*a*, 4*a* onto the casing as described in Cdn. App. 2350681. For such applications the material of the centralizer body 1 in one or both of the end intervals 3*a*, 4*a* can be selected to preferably have its elastic limit less than that of the casing joint 9.

As an alternate method of attachment providing axial load and torque transfer, one or both of the centralizer end intervals may be provided with set screws (not shown). Once positioned on the pipe, the set screws are tightened to fix the centralizer in place, which method of attachment is well known to the industry. Similarly, the centralizer may be secured by use of welding or by injecting grout or other adhesive into the interface between the centralizer bore and casing, which method of affixing centralizers is also known in the art.

In a further embodiment, for applications requiring axial position control of the centralizer on the pipe but allowing rotation without significant torque transfer, FIG. 9 shows cylindrical stop rings 10 provided and placed on the pipe to secure the centralizer 1 therebetween. The stop rings 10 are affixed to the casing in a manner preventing axial sliding. In one embodiment, the stop rings are provided with set screws 11 and affixed to the pipe in a manner well known to the industry. In their preferred embodiment, the stop rings 10 are provided without set screws 11 and made from a ductile material suitable for attachment to the pipe by crimping.

It will be apparent that these and many other changes may be made to the illustrative embodiments, while falling within the scope of the invention, and it is intended that all such changes be covered by the claims appended hereto.

The invention claimed is:

1. A method for producing a centralizer, the method comprising the steps of:

providing a length of metal tubular work piece, the work piece having a longitudinal axis, a sidewall and a central opening, inside a confining surface comprised of first and second mold elements, each of the mold elements having a cylindrical sidewall, inner and outer ends, a slot extending from its inner end, the mold elements having their inner ends in abutment such that the slots mate at the inner ends to a configuration of a side wall centralizer rib, the mold elements being supported within a housing assembly substantially against expansion radially outward from their position about the tubular work piece;

inserting a mandrel having a cylindrical exterior into the tubular work piece and sealing between an outer diameter portion of the mandrel and an inner diameter portion of the tubular work piece to define a sealed annular space between the mandrel and the tubular work piece;

applying sufficient fluid pressure to the annular space to force the tubular sidewall radially outward against the confining surface and into the mold cavities to plastically deform the side wall to form centralizer ribs on the side wall;

removing the tubular work piece from the confining surface;

wherein the confining surface further comprises:

a cylindrical bell having a tapered bore therein with a larger inner diameter at one end of the bell than at another end of the bell;

a collet having a tapered outer surface that mates with the inner diameter of the bore, the mold elements being located within the collet; and removing the tubular work piece from the confining surface comprises:

moving the collet axially relative to the bell; then removing the tubular work piece along with the mold elements from the collet.

2. The method of claim 1 wherein:

each mold element has a cylindrical inner diameter and an end that abuts an end of an adjacent one of the mold elements; and each cavity has a portion extending to one of the ends of the mold elements, the portions of the cavity joining each other.

3. The method of claim 2 wherein the mold elements contain axially extending slits to permit their circumferential expansion.

4. The method of claim 1 wherein the step of sealing between an outer diameter portion of the mandrel and an inner diameter portion of the tubular work piece comprises placing annular seals between the tubular work piece and the mandrel at axially spaced apart distances.

5. The method of claim 1 wherein upon removal of the centralizer from the confining surface, the tubular work piece sidewall is of substantially uniform thickness.

6. The method of claim 1 further comprising applying a friction-reducing coating to the tubular work piece inner diameter portion once the tubular work piece has been removed from the confining surface.

7. The method of claim 1 further comprising treating exterior surfaces of the ribs to increase their wear resistance once the tubular work piece has been removed from the confining surface.

8. The method of claim 1 wherein removing the centralizer from the confining surface includes expanding the mold elements to overcome their hoop stress.

9. The method of claim 1 wherein the ribs are formed to protrude smoothly from the sidewall cylindrical outer surface.

10. A method for producing a centralizer for a pipe comprising:

providing a tubular work piece selected to be formed into the centralizer having a central opening defining an inner diameter and a sidewall having an inner-facing surface directed toward the central opening and an outer-facing surface;

providing a mold including two mold elements, each being a tubular member having an inner end and an outer end, each mold element having a plurality of elongated slots, each with an opening at the inner end, each slot having a length extending toward the outer;

positioning the tubular work piece in the mold elements and the mold elements such that the inner ends of the mold elements abut each other, the openings of the slots in one of the mold elements mate with the openings of the slots in the other of the mold elements to define cavities with perimeters shaped like centralizer ribs;

providing a bell with a chamber having a longitudinal chamber axis;

inserting the mold elements and the tubular work piece together along the chamber axis and into the chamber within the bell; then applying sufficient fluid pressure against the sidewall to force the sidewall out against the mold elements and into the cavities of the mold elements to form a centralizer having ribs protruding outwardly from its outer surface;

removing the centralizer and the mold elements from the bell by moving the centralizer and the mold elements along the chamber axis; then removing the mold elements from the centralizer by sliding the mold elements in opposite axial directions relative to a longitudinal axis of the centralizer.

11. The method of claim 10 wherein the step of inserting comprises:

inserting a mandrel into the central opening of the tubular work piece such that an annular space is formed between the mandrel and the sidewall inner facing surface;

sealing about the annular space; and the step of applying sufficient fluid pressure includes introducing fluid pressure to the annular space.

12. The method of claim 10 wherein the fluid pressure is air pressure.

13. The method of claim 10 wherein the fluid pressure is hydraulic pressure.

14. The method of claim 10 wherein the mold elements contain axially-extending slits to permit their circumferential expansion while being removed from the centralizer.

15. The method of claim 10 wherein the mold further comprises:

a tapered bore in the bell with a larger inner diameter at one end of the bell than at another end of the bell;

a collet having a tapered outer surface that mates with the inner diameter of the bore, the mold elements being located within the collet; and removing the tubular work piece from the bell comprises:

moving the collet axially relative to the bell; then removing the tubular work piece along with the mold elements from the collet.

16. The method of claim 10 wherein each mold element defines a portion of a cavity.

17. The method of claim 10 wherein the mold elements contain slits to permit their circumferential expansion.

18. The method of claim 10 wherein upon removal of the centralizer from the bell, the centralizer sidewall is of substantially uniform thickness.

19. The method of claim 10 further comprising applying a friction reducing coating to the centralizer inner surface once the centralizer has been removed from the bell.

20. The method of claim 10 further comprising treating exterior surfaces of the ribs to increase their wear resistance once the centralizer has been removed from the bell.

21. The method of claim 10 wherein removing the mold elements from the centralizer includes expanding the mold elements to overcome their hoop stress.

22. A method for producing a centralizer, the method comprising the steps of:

(a) providing a length of metal tubular work piece, the work piece having a longitudinal axis, a sidewall and a central opening;

(b) inserting the work piece inside a confining surface comprised of two mold elements, each of the mold elements having a unitary cylindrical sidewall, inner and outer ends, a plurality of elongated slots, each slot extending along the sidewall and having an opening at the inner end and a termination spaced from the inner end, the mold elements having their inner ends in abutment with each other such that the openings of the slots mate at the inner ends to define elongated mold cavities, each cavity having a configuration of a desired side wall centralizer rib;

(c) inserting a mandrel having a cylindrical exterior into the tubular work piece and through the mold elements, and sealing between an outer diameter portion of the mandrel and an inner diameter portion of the tubular work piece to define a sealed annular space between the mandrel and the tubular work piece;

(d) inserting the mold elements, the work piece, and the mandrel into a chamber of a housing assembly;

(e) applying sufficient fluid pressure to the annular space to force the tubular sidewall radially outward against the confining surface and into the mold cavities to plastically deform the side wall to form centralizer ribs on the side wall; then (f) removing the mold elements, the mandrel, and tubular work piece from the chamber in the housing assembly; then (g) sliding the mold elements in opposite axial directions relative to each other, removing them from the work piece.

23. The method according to claim 22, wherein:

the chamber of the housing assembly has a cylindrical inner diameter that has a chamber axis;

step (d) comprises inserting the mold elements and the work piece along the chamber axis into the chamber; and step (f) comprises withdrawing the mold elements and the work piece along the chamber axis.

24. The method according to claim 22, wherein step (b) comprises providing each of the mold elements with an axial length greater than an inner diameter of each of the mold elements.

25. The method according to claim 22, wherein:

the housing assembly of step (d) comprises a bell and a collet located within the bell, the collet and the bell having tapered mating surfaces;

the mold elements are located within a bore of the collet in step (e); and step (f) comprises withdrawing the collet, the mold elements, and the work piece from the bell.

26. The method according to claim 22, wherein:

the mold elements contain axially extending slits to permit their circumferential expansion during step (g).

27. The method according to claim 22, wherein:

the chamber of the housing assembly has open opposite ends; and in step (d) the mandrel protrudes from both ends of the chamber.

* * * * *